US012734434B2

(12) United States Patent
Roth

(10) Patent No.: US 12,734,434 B2
(45) Date of Patent: Sep. 15, 2026

(54) STACKABLE GAME CONFIGURED FOR HANDS-FREE GAME PLAY

(71) Applicant: Stumbo Stack LLC, Boston, MA (US)

(72) Inventor: Samuel Roth, Boston, MA (US)

(73) Assignee: Stumbo Stack LLC, Boston, MA (US)

( * ) Notice: Subject to any disclaimer, the term of this patent is extended or adjusted under 35 U.S.C. 154(b) by 0 days.

(21) Appl. No.: 19/308,423

(22) Filed: Aug. 25, 2025

(65) Prior Publication Data

US 2026/0061302 A1 Mar. 5, 2026

Related U.S. Application Data

(60) Provisional application No. 63/687,665, filed on Aug. 27, 2024, provisional application No. 63/733,259, filed on Dec. 12, 2024.

(51) Int. Cl.
*A63F 9/00* (2006.01)

(52) U.S. Cl.
CPC ..... *A63F 9/0073* (2013.01); *A63F 2250/497* (2013.01); *A63F 2250/601* (2013.01)

(58) Field of Classification Search
CPC combination set(s) only.
See application file for complete search history.

(56) References Cited

U.S. PATENT DOCUMENTS 1,565,901 A * 12/1925 Brandt ..... A63F 9/12 273/153 P
2,252,678 A * 8/1941 Mccbeary ..... G09B 19/0023 D11/131
2,679,711 A * 6/1954 Learnard ..... A42B 1/02 428/6
3,098,316 A * 7/1963 Mccarthy ..... A63B 21/0608 D2/869

(Continued)

FOREIGN PATENT DOCUMENTS

CN 106422305 A * 2/2017 ..... A63F 9/001
FR 2804615 B1 5/2002

(Continued)

OTHER PUBLICATIONS

CN 106422305 A (Year: 2017).*
JP 3149741 U (Year: 2009).*

*Primary Examiner* — John E Simms, Jr.
*Assistant Examiner* — Amir A Klayman
(74) *Attorney, Agent, or Firm* — Build IP, LLC; Robert V. Donahoe

(57) ABSTRACT

A set of game pieces sized and shaped to stack vertically one atop one another to form a stacked arrangement. The set of game pieces including a first game piece configured to place at a bottom position in the stacked arrangement and a second game piece configured to place at a top position in the stacked arrangement wherein each of the game pieces included in the set of game pieces includes a top surface having a game-piece fastening element included thereon, (Continued)

respectively, each of the respective game-piece fastening elements configured to secure to a corresponding headpiece fastening element worn by a user when contact is made between the respective game-piece fastening element and headpiece fastening element during game play. Game play involves a hands-free removal of game pieces from atop the stacked arrangement.

11 Claims, 12 Drawing Sheets

(56) References Cited

U.S. PATENT DOCUMENTS 3,118,669 A 1/1964 Merrill
3,454,279 A 7/1969 Foley et al.
3,628,794 A 12/1971 Conture
3,705,466 A * 12/1972 Sela ..... A42B 1/245 446/27
3,712,616 A * 1/1973 Goldfarb ..... A63F 9/0073 273/447
3,843,220 A * 10/1974 Snider ..... B65D 21/0235 428/7
3,870,312 A * 3/1975 Hamar ..... A63F 9/00 273/276
3,901,505 A 8/1975 Gerechter
4,203,525 A * 5/1980 Okubo ..... A63B 5/12 482/25
4,352,352 A 10/1982 Janovsky et al.
4,437,668 A * 3/1984 Simpson ..... A63F 9/1288 273/156
4,461,790 A * 7/1984 Snider ..... B65D 85/60 D7/610
D275,022 S * 8/1984 Simpson ..... D21/478
4,488,316 A * 12/1984 Mosca ..... A42B 1/24 2/200.1
4,488,373 A * 12/1984 Glickson ..... A63H 33/103 446/490
4,699,601 A * 10/1987 Hershfeld ..... A63H 33/00 446/117
4,718,677 A 1/1988 Barnes
4,826,171 A * 5/1989 Morse ..... A63F 9/12 273/160
4,914,755 A * 4/1990 Motley ..... A42B 1/248 2/200.2
4,936,575 A * 6/1990 Ortiz ..... A63F 9/0073 273/440
5,027,992 A * 7/1991 Murray, III ..... G09F 21/02 D2/869
5,037,091 A 8/1991 Hagood
5,082,291 A 1/1992 Appel et al.
5,255,394 A * 10/1993 Long ..... A42B 3/0406 224/181
5,385,326 A * 1/1995 Bidwell ..... A47G 23/03 248/908
5,412,545 A * 5/1995 Rising ..... F21V 21/084 362/427
5,427,123 A * 6/1995 Odenthal ..... A45D 8/36 132/275
5,722,663 A 3/1998 Avigal et al.
5,734,991 A * 4/1998 Schmid ..... A42B 1/24 2/69
5,803,266 A * 9/1998 Blackwelder ..... A45F 5/02 2/244
5,996,116 A * 12/1999 Tate ..... A63B 57/207 2/200.1
6,047,709 A * 4/2000 Tu ..... A45D 8/36 132/273
6,163,889 A * 12/2000 Tate ..... A63B 57/353 2/209.13
6,519,779 B1 * 2/2003 Taguchi ..... A42B 1/248 2/209.12
6,532,601 B1 * 3/2003 Berman ..... A42B 3/0406 2/209.13
6,767,355 B2 * 7/2004 Frova ..... A61M 16/0429 606/191
7,510,188 B2 * 3/2009 Yang ..... A63F 9/181 273/123 R
7,566,057 B2 * 7/2009 Mascolo ..... A63F 9/0073 273/153 S
D599,416 S * 9/2009 Turco-Rivas ..... D21/471
9,185,944 B2 * 11/2015 Zhen ..... A42B 1/24
9,326,483 B2 * 5/2016 Hall ..... A01K 1/033
10,470,531 B1 * 11/2019 Yanes ..... A44C 1/00
D957,541 S * 7/2022 Wang ..... D21/471
11,850,532 B2 * 12/2023 Simchoni ..... A63H 33/04
11,951,413 B2 * 4/2024 Hamilton ..... A41D 20/00
12,262,771 B2 * 4/2025 Böck ..... A42B 1/248
2002/0034992 A1 * 3/2002 Tate ..... A63B 57/207 473/406
2005/0229944 A1 * 10/2005 Pena ..... A45D 8/001 132/273
2009/0032044 A1 * 2/2009 Grimm ..... A45D 8/12 132/273
2011/0254225 A1 * 10/2011 Doherty ..... A44B 5/002 273/287
2014/0131947 A1 * 5/2014 Swartz ..... A63F 1/04 273/292
2014/0197596 A1 7/2014 Mcilwaine
2020/0404997 A1 * 12/2020 Davis ..... A42B 1/017
2021/0208818 A1 * 7/2021 Zheng ..... G06F 16/2453
2021/0236933 A1 * 8/2021 Gibbons ..... A63F 11/0051
2023/0310979 A1 * 10/2023 Cipri ..... A63F 13/80 273/146

FOREIGN PATENT DOCUMENTS

GB 2236955 A * 4/1991 ..... A63F 9/0073
JP 3149741 U * 4/2009

* cited by examiner

STACKABLE GAME CONFIGURED FOR HANDS-FREE GAME PLAY

BACKGROUND OF INVENTION

1. Field of Invention

This invention relates generally to stacking and lifting games played by participants. More specifically, at least one embodiment relates to apparatus, systems and method for a stackable game configured for hands-free game play.

2. Discussion of Related Art

Traditional games like "Bite the Bag" and "The Box Game" require that players use their teeth to pick up and lift objects. In these games, a player may either succeed or fail to lift a grocery bag or box of beer before the next round begins, at which point a layer is ripped off the object. While this adds a physical challenge for participants, it also introduces a destructive element to the gameplay because the original object is diminished over time.

This destructive nature can also detract from the enjoyment, as the game's progression results in a messy environment, uneven height of bags or boxes, and a compromised playing surface that limits the potential for multiple rounds. Because these games are inherently destructive, they cannot be played repeatedly in the same format. These factors can also reduce an overall appeal of these types of games. In addition, these games primarily rely on teeth for the lifting action. This can lead to discomfort or injury for players as well as a less hygienic atmosphere In addition, the field of stacking and lifting games most often requires the use of a player's hands. While this allows for player success in game play it also reduces the challenge and novelty for players seeking a more engaging experience.

SUMMARY OF INVENTION

Therefore, there is a need for games that combines the physical challenge of lifting with the strategic complexity of stacking while avoiding the destructive aspects and other drawbacks. In addition, there is a need for games that include a challenge of hands-free removal of stacked items, that is, a hands-free disassembly of items from an unsupported stack while keeping the game pieces that remain in a vertically stacked arrangement.

This invention introduces a novel approach by incorporating hook and loop-attached body-mounted fastening element that allow players to temporarily secure a game piece to their body, without using their hands, to lift and move the game piece using another part of their body. According to some embodiments, the body-mounted fastening element is included in a headpiece worn by the player, for example, a headband including the body-mounted fastening element. However, other embodiments include a body-mounted fastening element that is worn on a body-part other than the head. For example, a band including a body-mounted fastening element can be configured to secure on a portion of a limb such as a forearm, upper arm, foot, calf or thigh. Further, in any of the preceding embodiments, the fastening element can include any one or any combination of a magnetic fastening element, tape or other tacky adhesive fastening element, or other material that allows for a creation of a temporary attachment between the body-mounted fastening element and a corresponding fastening element included on the game pieces.

According to various embodiments, a modular stacking game includes components of varying diameters and heights. These components are designed to nest within one another when not in use, making the game compact and easily portable. During gameplay, the components stack on top of each other to form a multi-level structure. According to one embodiment, hook and loop strips on the surfaces of these components or grooves may allow them to attach securely to one another, ensuring stability during play. The game may include a set of headbands with integrated hook and loop patches that allow players to lift and manipulate the stacked components without allowing their hands or knees to touch the ground.

In various embodiments, gameplay involves stacking the components in ascending order followed by a sequential set of rounds in which a player is challenged to remove the current top layer by placing a headpiece fastening element into contact with a game-piece fastening element located on a top surface of the then-current top piece. The pressure between the two fastening elements temporarily fastens the top piece to the headpiece to allow the player to lift and remove the current top game piece from off the remaining stacked game pieces. As players succeed, components are removed one by one, increasing the challenge. The final stage of the game can involve lifting the bottommost layer lying flat on the ground in the same fashion. According to some further embodiments, in case of a tie, bonus layers are provided for additional challenges, where the first player to lift the bonus layer wins. The invention's modular design, case of transport, and adjustable difficulty levels make it suitable for various environments and occasions. In addition, the game is designed to be accessible for various environments, including outdoor and indoor settings, and offers potential as a social or drinking game, adding an extra layer of fun and engagement for attendees.

According to some embodiments, a set of stacked game pieces are moved by participants via a temporary attachment of the game piece to a headband worn around the player's head. The player faces an increased level of difficulty with the removal of each layer because they must bend further down as the height of the stacked game pieces decreases.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
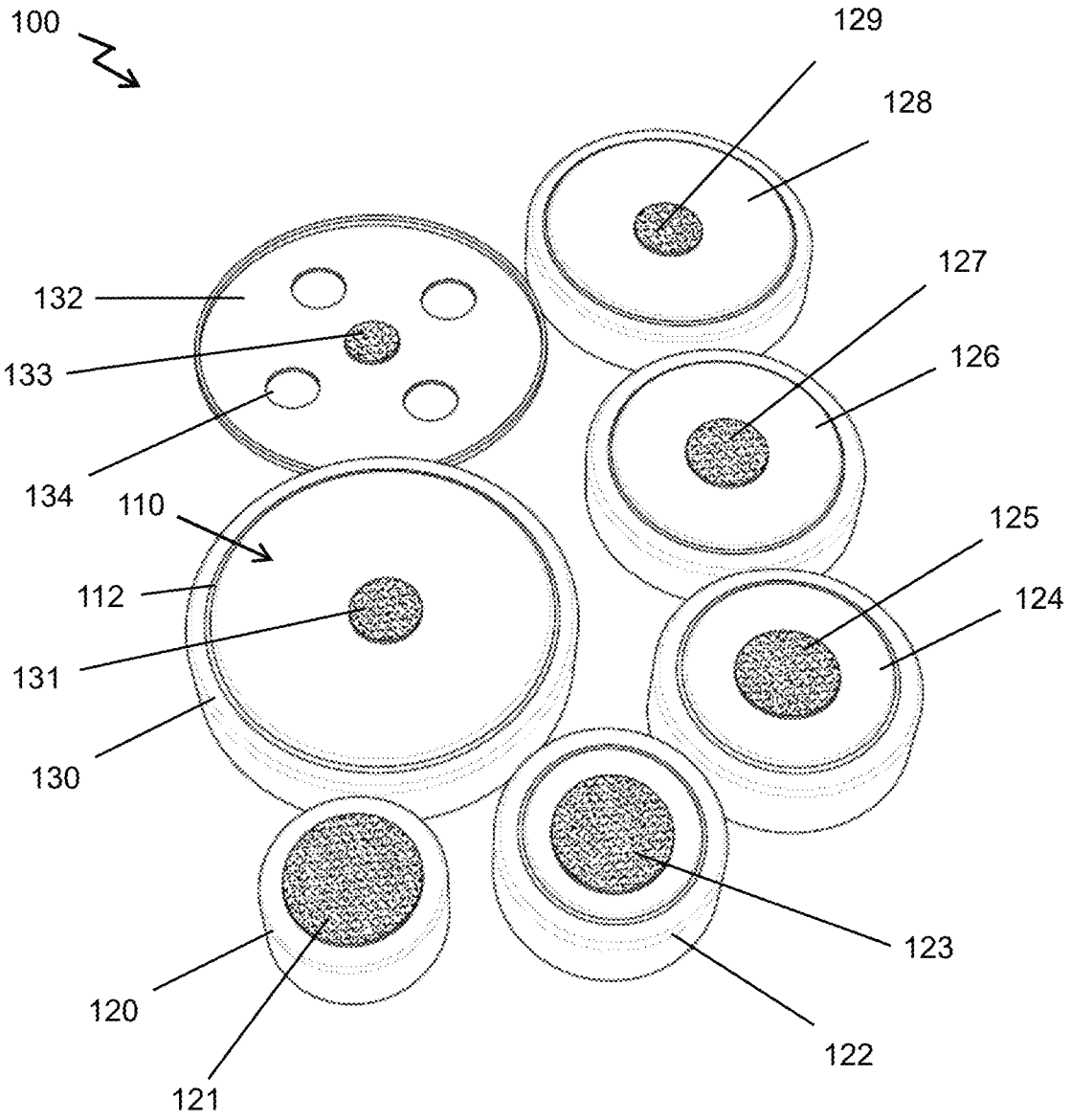
FIG. 1 illustrates a top isometric view of a set of game pieces in accordance with one embodiment.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Referring now to FIG. 1, a top isometric view of a set of game pieces 100 is illustrated in accordance with various embodiments. The set of game pieces 100 includes a first game piece 120, a second game piece 122, a third game piece 124, a fourth game piece 126, a fifth game piece 128, a sixth game piece 130 and a base 132. According to the illustrated embodiment, each piece included in the set of game pieces 100 includes a game-piece fastener located on atop the upper surface of the game piece. These include a first game-piece fastener 121 included with the first game piece 120; a second game-piece fastener 123 included with the second game piece 122; a third game-piece fastener 125 included with the third game piece 124; a fourth game-piece fastener 127 included with the fourth game piece 126; a fifth game-piece fastener 129 included with the fifth game piece 128; a sixth game-piece fastener 131 included with the sixth game piece 130; and a seventh game piece fastener 133 included with the base 132. The game-piece fasteners are centrally located on the top surface of the games pieces, respectively, in the illustrated embodiment.

While the game pieces and associated game-piece fasteners can include different shapes depending on the embodiment, each piece included in the set of game pieces 100 has an overall circular-shaped top surface including a game-piece adhesive region having a circular shape in the illustrated embodiment. For example, referring to the sixth game piece 130 as an exemplary reference concerning the structure of each of the game pieces 120, 122, 124, 126, 128, 130, the game pieces each defines an overall cylindrical shaped with a top surface 110 that includes a game-piece fastener (for example, the game-piece fastener 131) and a groove (for example, the groove 112) formed in the top surface 110. Because it is much thinner, the base 132 defines a disc-like shape. The base 132 includes a set of openings, with a first opening 134 identified with a reference character exemplary of all four of the openings included in the illustrated embodiment.

The openings 134 can be included to prevent a partial vacuum seal from preventing an easy removal of the sixth game piece 130 from being lifted off the base 132. According to other embodiments, one or more of the respective top surfaces included game pieces 122, 124, 126, 128, 130 other than the first game piece 120 include at least one opening. The openings can provide a through-passage from the top surface to an underside of a top wall of the game piece. In some embodiments, the through-passage provides an opening from the top surface to a hollow region within the game piece. The through-passages prevent a partial vacuum attachment between any of the stacked game pieces. According to this embodiment, an opening is not needed for the first game piece 120 because it is the topmost piece in the stacked arrangement and has nothing set on it.

In general and as described in greater detail below, according to some embodiments, the set of game pieces 100 are employed in combination with one or more associated headpieces included in a game-set. For game play, the set of game pieces are configured in a vertical stack on the base 132 in descending order of increasing diameter to place the game piece having the smallest diameter atop the stack of game pieces. Players wear a headpiece including a headpiece fastening element and move their body to attach the headpiece fastening element to the respective game-piece fastening element of a topmost game piece included in the plurality of game pieces in the stacked configuration to remove the topmost game piece and to do so without their hands. The topmost game piece is then detached from the headpiece. The player returns to the stacked arrangement as it remains following the removal of the topmost game piece to try and repeat the process for that next lowest piece, that is the game piece that the topmost game piece previously rested upon (now the uppermost game piece in the stacked arrangement). The challenge increases as the elevation of the stack of game pieces successively decreases with a removal of each of the plurality of game pieces included in the stack of game pieces.

Game play can also include one more bonus rounds to provide a further challenge to those players that have already disassembled the stacked arrangement. According to various embodiments, the bonus rounds employs accessory game pieces that are configured to provide this added challenge. Depending on the embodiment, these can include accessory game pieces that have features including customizable game-piece shapes, sizes, and weights, game-piece fastening elements with different shapes, size or textures. The accessory game pieces can be used for multi-player game play to, for example, provide varied challenges during tie-breaking rounds.

Figure 2:
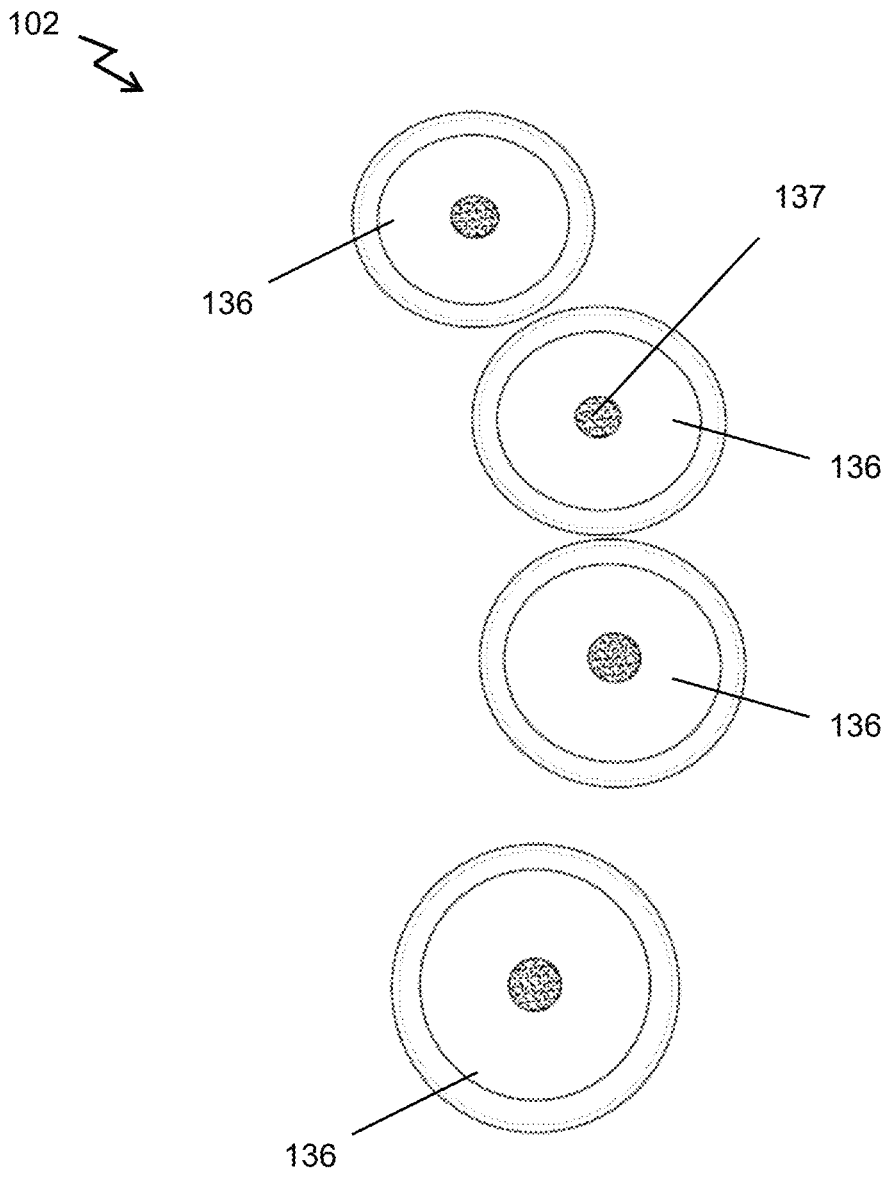
FIG. 2 illustrates a top view of a set of accessory game pieces in accordance with one embodiment.

Referring now to FIG. 2, a set of accessory game pieces 102 is illustrated in accordance with one embodiment. According to these embodiments, these include four discs 136 each including a game-piece fastening element 137. According to the illustrated embodiment, the accessory game pieces 136 are thin discs with a smaller diameter of both the disc and the game-piece fastening element 137 to increase the degree of difficulty for the players.

FIG. 1 illustrates that in some embodiments, the set of game pieces 100 includes varying diameters with each of the game pieces including a corresponding game-piece fastening element. In the illustrated embodiment, the game-piece fastening elements also include varying diameters the size of which are controlled. In particular, the game-piece fastening element having the greatest surface area is included in the first game piece 120 located atop the stacked arrangement of game pieces. The surface area is decreased in game pieces that will be placed lower in the stacked arrangement. For example, in the illustrated embodiment, the diameter of the circular-shaped game-piece fastening elements incrementally decreases as the diameter of the game pieces increases such that the base 132 has the game-piece fastening element 133 with the smallest diameter among the set of game pieces 100. As is described below, the change in diameter of the game pieces assists in creating a stable configuration when the set of game pieces 100 are organized in a stacked arrangement. However, the change in surface area, which results in a reduction in a target area by which the game piece can be secured to the headpiece worn by the user, can be used to increase the degree of difficulty at each successive stage of game play.

Figure 3:
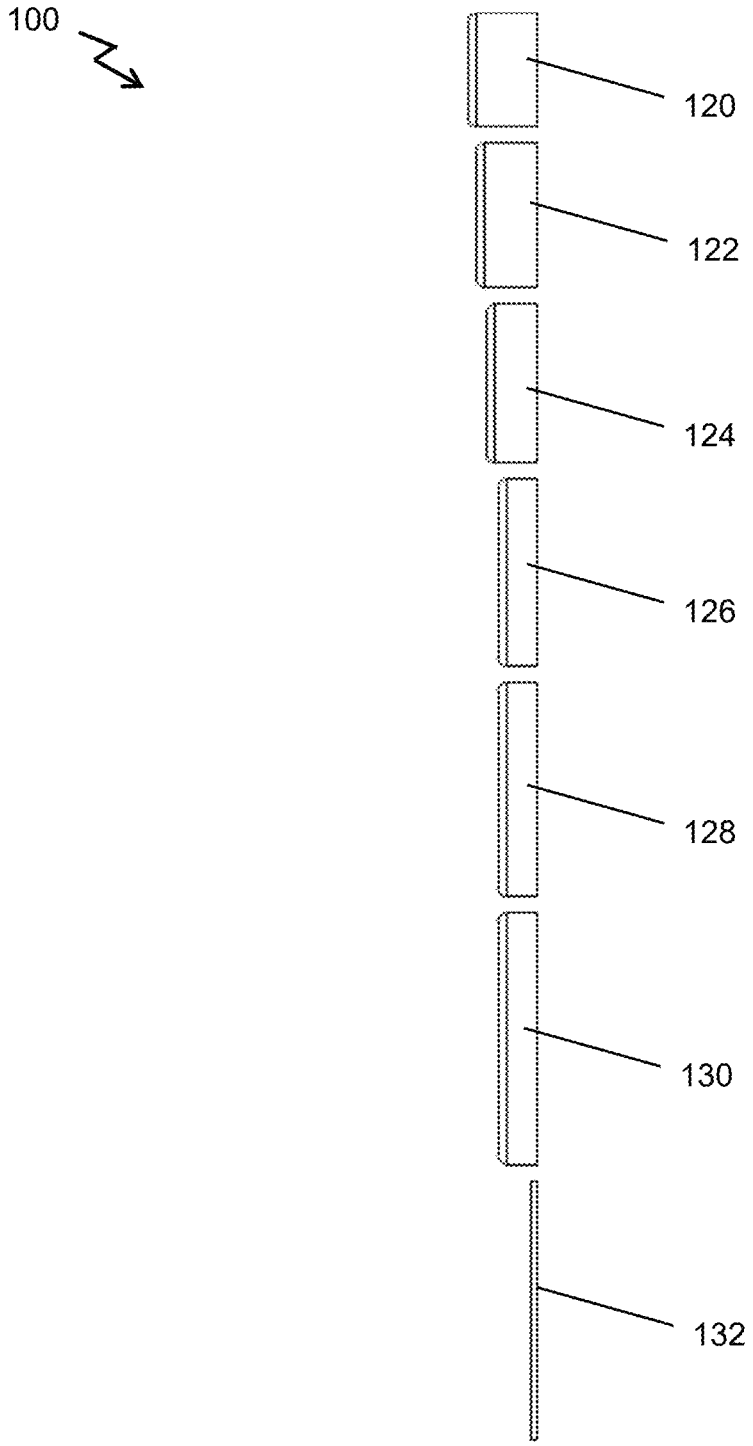
FIG. 3 illustrates an elevation view of the set of game pieces of FIG. 1 placed side by side.

Referring now to FIG. 3, the elevation view of the set of game pieces of FIG. 1 placed side by side illustrates that the height of each game piece included in the set of game pieces 100 can also vary by game piece. According to the illustrated embodiment, the height of the various game pieces gradually decreases from with the first game piece 120 (placed atop a stack of game pieces for game play) having the greatest height and the base 132 (placed at the bottom of a stack of game pieces) having the smallest height. This change in sizing from game piece to game piece can be employed to adjust the degree of difficulty at each stage of game play along with a pace at which the degree of difficulty changes. In the illustrated embodiment, the first game piece 120, the second game piece 122 and the third game piece 124 have relatively large heights when compared to the remaining game pieces 126, 128, 130, and the base 132. According to one embodiment, each of the first game piece 120, the second game piece 122 and the third game piece 124 are approximately two inches in height, each of the fourth game piece 126, the fifth game piece 128 and the sixth game piece 130 are shorter, each having a height of approximately one and a half inches in height, and the base is flat with a minimal height dimension.

As described with reference to the embodiments illustrated in FIGS. 4 and 5, the game pieces 120, 122, 124 having the greatest height form the upper layers when the set of game pieces 100 are organized in a stacked arrangement for game play. The game pieces 126, 128, 130 having the shorter height form the lower layers when the set of game pieces 100 are organized in a stacked arrangement for game play. The base 132 is placed as the bottom layer upon which the remaining stack of game pieces sits. In practice, the increased thickness of the upper pieces results in the height of the stacked arrangement of game pieces decreasing more quickly as pieces are removed during the initial stages of game play. The more rapid decrease in height acts to quickly increase the degree of difficulty at each interval because the player is forced to reach lower and lower as the game progresses to remove the next game piece using the headpiece and without the use of their hands.

Figure 4:
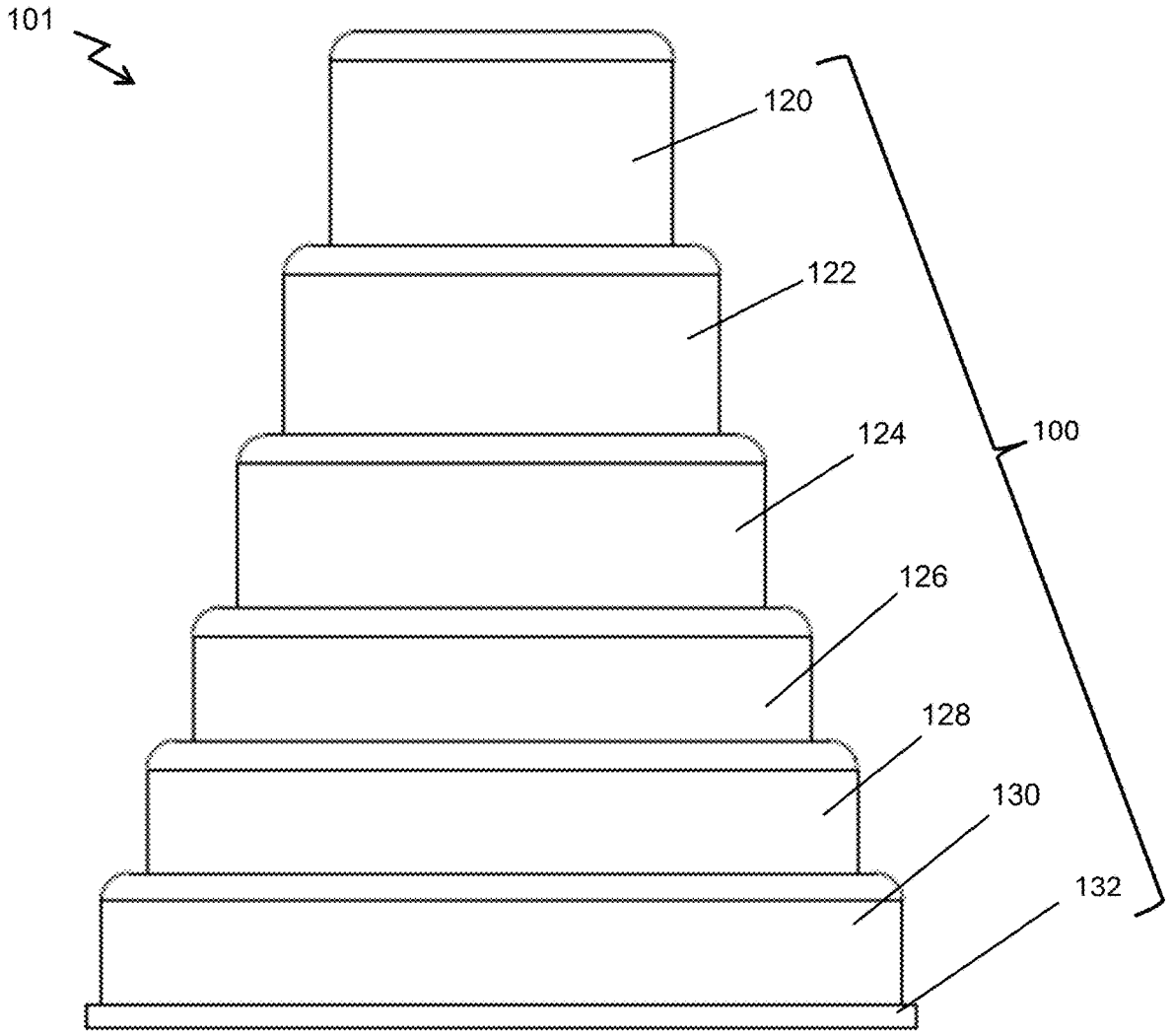
FIG. 4 illustrates an elevation view of the set of game pieces of FIG. 1 placed in a stacked arrangement.

Referring to FIG. 4, the set of game pieces 100 organized in a stacked arrangement 101 is illustrated in an elevation view. In general, the stacked arrangement 101 is placed on a flat surface. Further, the stack is unsupported but for the flat, level surface on which the stack rests. In addition, a flat surface that is not level can also be used in some embodiments, for example, to increase the degree of difficulty. While a stacked arrangement 101 can include fewer or more game pieces, the stack illustrated in FIG. 4 includes in descending order from the top of the stack: the first game piece 120; the second game piece 122; the third game piece 124; the fourth game piece 126; the fifth game 128, the sixth game piece 130; and the base 132. According to these embodiments, the stacked arrangement 101 can be formed by placing the base 132 on the flat surface and then placing each game piece atop a game piece having the next largest diameter. The result is that the game piece 120, 122, 124, 126, 128, 130 having the largest diameter is placed on the base 132. Thereafter, the game piece 130 having the next largest diameter is placed atop the base 132, the game piece 128 having the next largest diameter relative to the game piece 130 is placed atop the game piece 130. The same approach based on game piece diameters is followed with each piece in turn to incrementally increase the height of the stacked arrangement 101 until the top game piece, the game piece 120, is placed atop the game piece 122 to complete the stack.

In some embodiments, the flat surface is the same and/or located at the same elevation as the surface on which a player stands for game play. However, the elevation of a first surface where the stack is placed and the elevation of a second surface on which the player stands can differ. For example, the first surface can be a table top of a table that is placed on the same surface on which the player stands. This acts to elevate the stacked arrangement relative to the player standing adjacent to the table. The result is a lower degree of difficulty because the elevation of all the stacked game pieces 100 are raised relative to the player.

Figure 5:
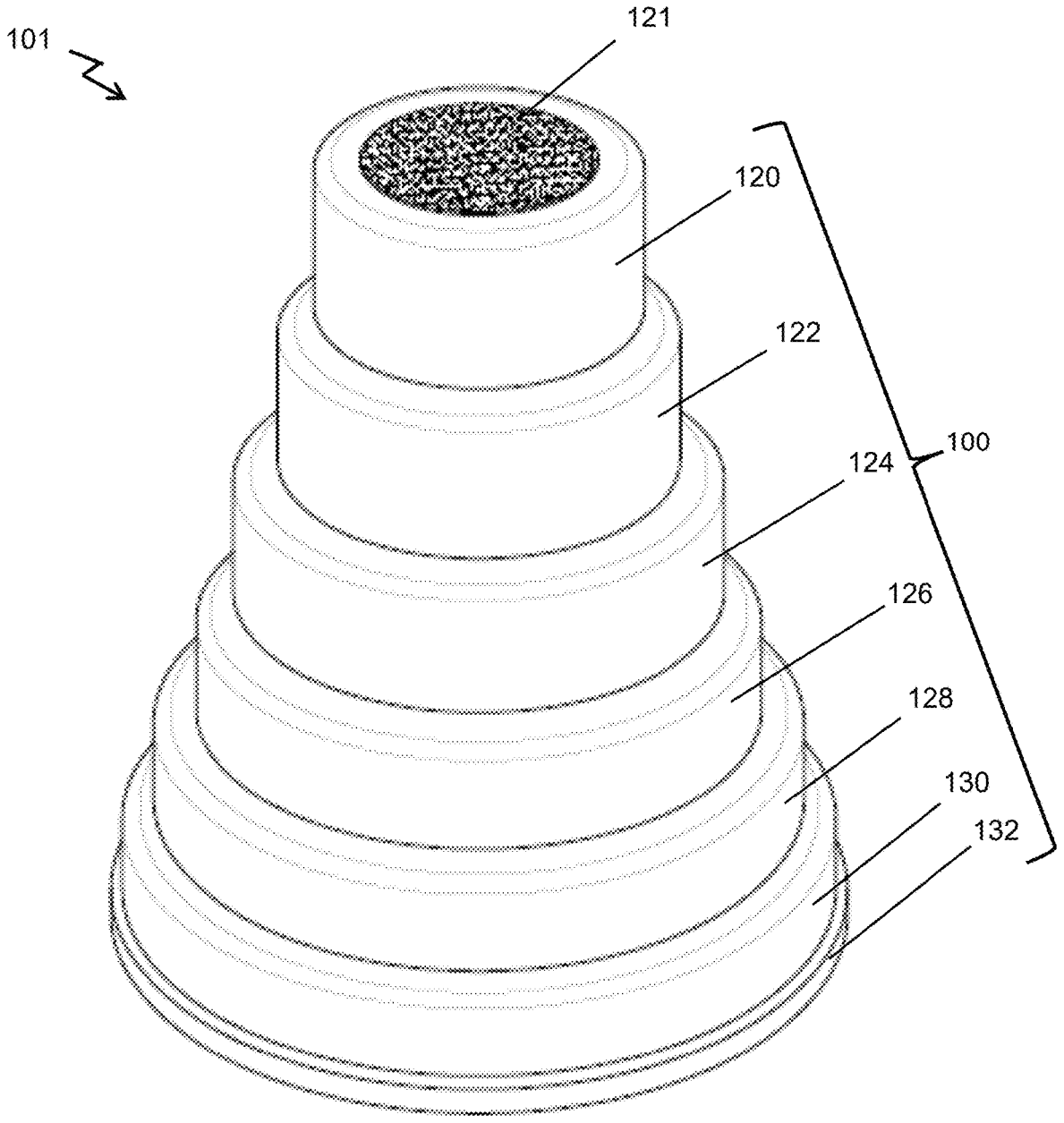
FIG. 5 illustrates a top isometric view of the set of game pieces of FIG. 1 placed in a stacked arrangement.

Referring to FIG. 5, the set of game pieces 100 organized in the stacked arrangement 101 is illustrated in top isometric view. According to this embodiment, the stacked arrangement 101 is prepared for a start of game play. This view illustrates that a top surface of only the first game-piece 120 is exposed with the stack 101 in place at the start of the game. This also exposes the first game-piece fastener 121 to the player at the start of game play. As is described in greater detail elsewhere herein, players sequentially remove a then-current top piece from the stacked arrangement 101 beginning with the first game piece 120 in a hands-free manner. The challenge increases as the elevation of the stack of game pieces successively decreases with a removal of each of the plurality of game pieces included in the stack of game pieces. The player will eventually lift the base 132 off the surface if they are skilled enough to do so.

Figure 6:
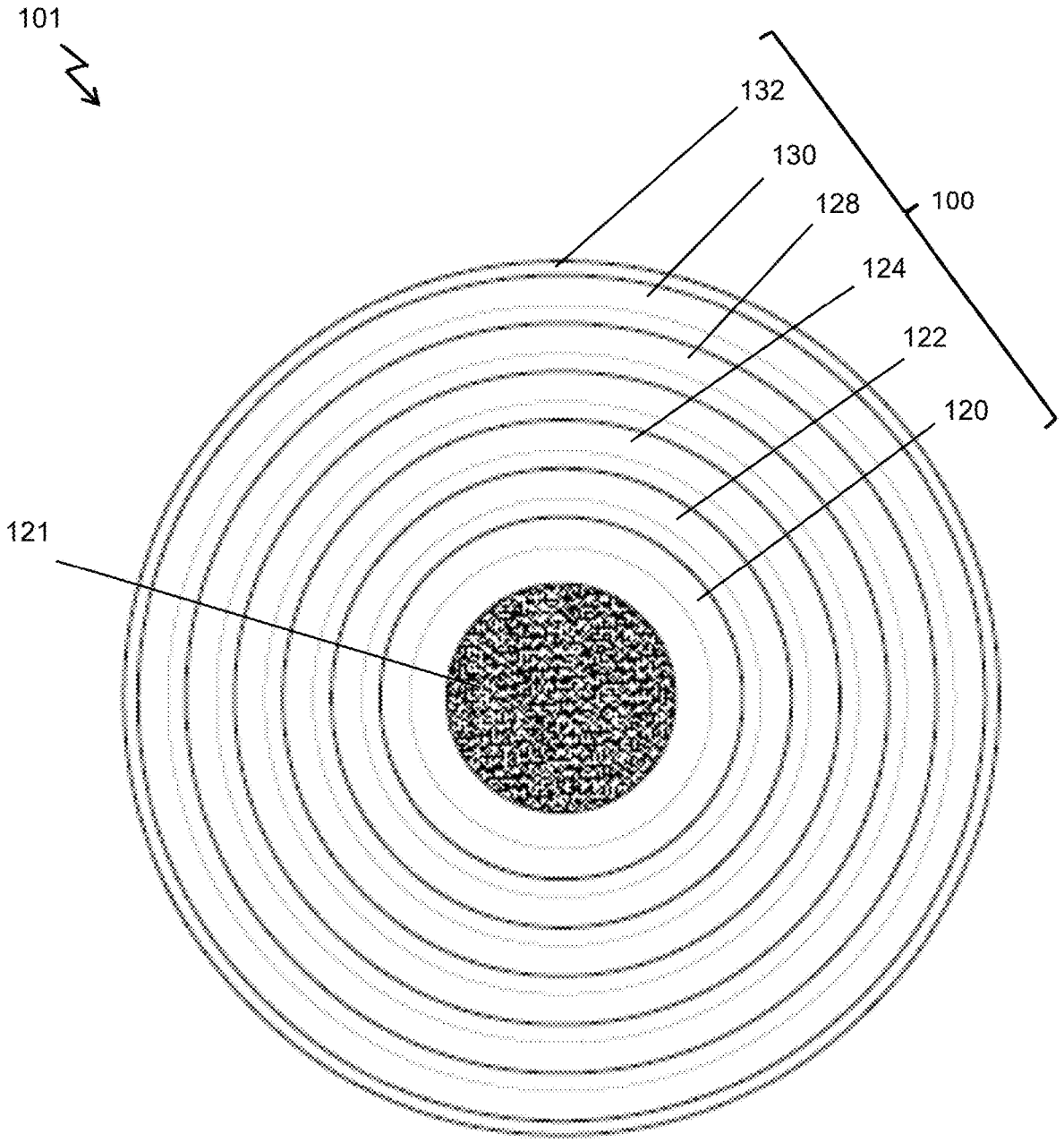
FIG. 6 illustrates a top view of set of game pieces of FIG. 1 in a stored configuration.

Referring to FIG. 6, the set of game pieces 100 organized in the stacked arrangement 101 is illustrated in a top view. The top view also illustrates the decrease in the outside diameter of each game pieces as the elevation of the stacked arrangement 101 increases. This places the base 132 at the bottom, the remaining game pieces 120, 122, 124, 126, 128, 130 stacked above it, with the first game piece 120 at the top to expose the first game-piece fastener 121.

Figure 7:
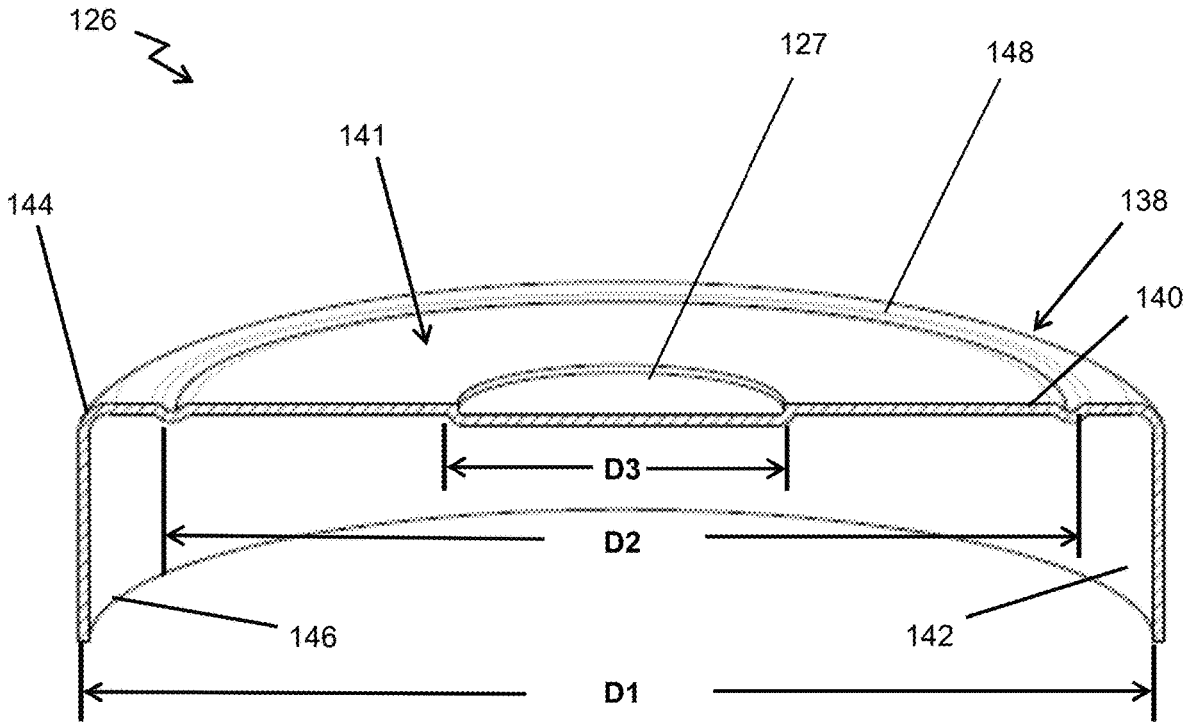
FIG. 7 illustrates a cross-sectional view of a game piece in accordance with one embodiment.

Referring now to FIG. 7, a cross-sectional view of an exemplary game piece is illustrated in accordance with one embodiment. In FIG. 7, the details of construction of the fourth game piece 126 are illustrated. The remaining game pieces 120, 122, 124, 128, 130 each have a corresponding set of features, respectively. The fourth game piece 126 includes a body 138 with a top wall 140, side wall 142, a top rim 144, a bottom rim 146 and a groove 148. The side wall 142 connect to the top wall 140 at the top rim 144 in an orientation that places the side wall 142 substantially perpendicular to the top wall 140. The top wall 140 defines a top surface 141 and an underside. In the illustrated embodiment, the groove 148 is formed in the top surface 140. The game-piece fastening element 127 is centrally located on and included as a part of the top surface 141 according to the illustrated embodiment.

Where the body 138 has an overall cylindrical shape, each of the top surface 140, the top rim 144 and the bottom rim 146 have a circular shape. According to the illustrated embodiment, a hollow interior region is defined in the area between the side wall 144 and an underside of the top wall 140. In this embodiment, the outside diameter D1 of the fourth game piece 126 is defined by the side wall 142. According to the illustrated embodiment, the groove 148 has an overall circular shape having a diameter D2. Depending on the embodiment, the body 138 is manufactured from plastic, for example, ABS. The manufacturing process can include injection molding using ABS or other types of plastic depending on the embodiment. According to another embodiment, each of the game pieces is manufactured from a cloth material. In these embodiments, the game piece can also include a wire within the game piece as a structural framework that provides the game piece with an overall cylindrical shaped body when in use.

According to the illustrated embodiment, the fourth game-piece fastener 127 also has an overall circular shape that covers a circular region having a diameter D3 on the top surface 141. Depending on the embodiment, the material of each of the game piece fasteners can be manufactured with hook and loop fastener material (VELCRO), a magnet, or an adhesive such as a tape. According to another embodiment, the game piece to headpiece attachment is accomplished via a snap fastener. According to these embodiments, the game-piece fastener includes a first portion (male or female of the snap) and the headpiece fastener includes a second portion (male or female of the snap) that mates with the first portion when the two portions are pressed into contact with one another.

The overall flat shape of the top surface 141 provides a stable surface on which to place a game piece atop the game piece beneath it in the stacked arrangement 101. In addition, the inclusion of the groove 148 provides an alignment structure that is used to assist in maintaining the position of a game piece atop the game piece below it in the stacked arrangement 101, for example, maintaining a lateral position atop the game piece below it. That is, locating the bottom rim 146 of the game piece within the groove 148 of the game piece within which it is set adds stability to the stacked arrangement without the use of any fastening means. In this embodiment, the diameter defined by the side wall 142 of the fourth game piece 126 is sized to match the diameter of the groove included in the fifth piece 128 upon which the fourth game piece 126 is placed in the stacked arrangement 121. According to other embodiments, the alignment structure can take other forms or include the groove in combination with other structural features. For example, a raised structure can be included on the top surface at an outer diameter that locates the raised structure inside the side wall and within the hollow region of the body of a game piece that is placed on the top surface.

Figure 8:
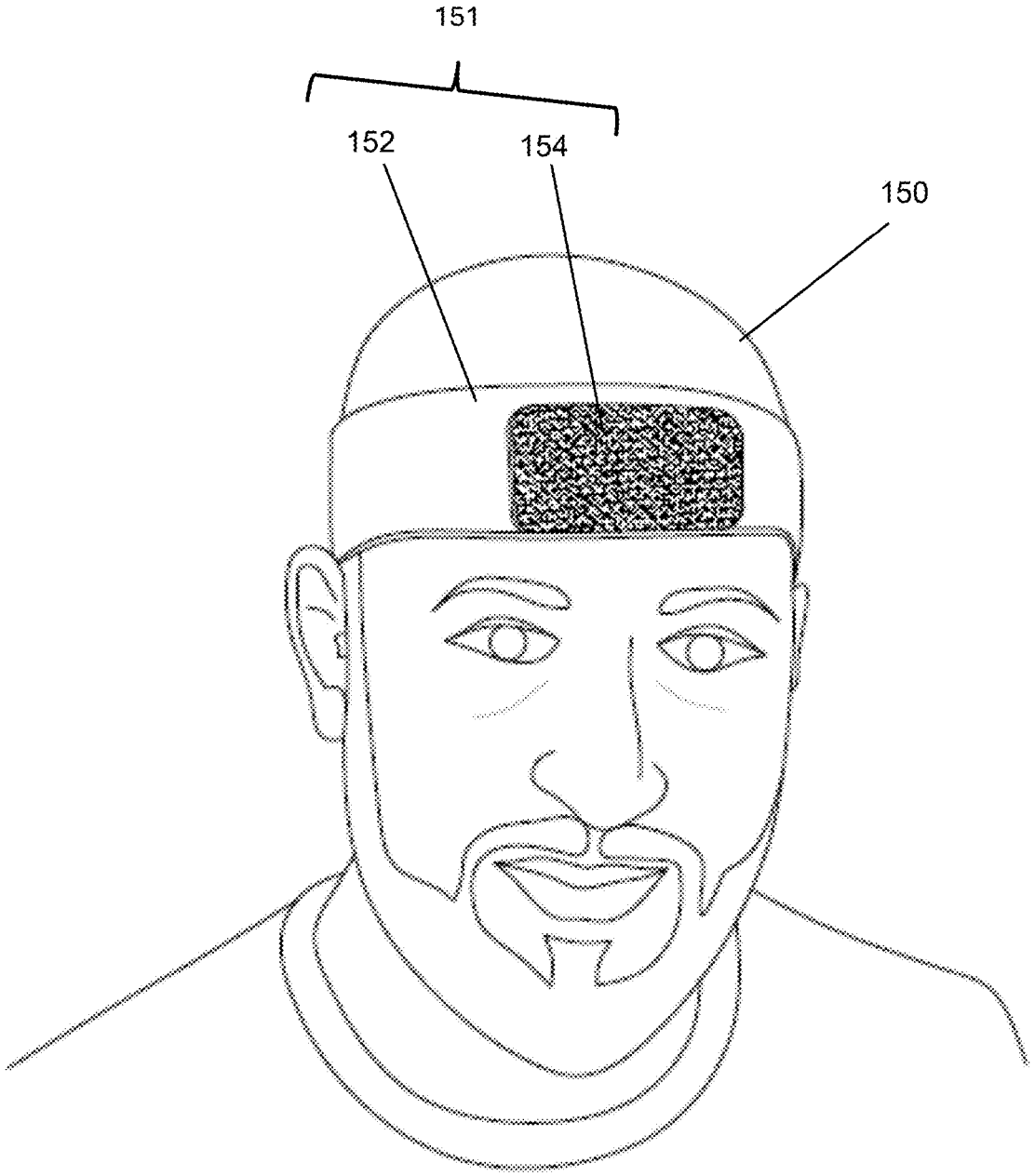
FIG. 8 illustrates a view of a user wearing a headpiece in accordance with one embodiment.

Referring now to FIG. 8, a player 150 is illustrated wearing a headpiece 151 for use in game play including a set of game pieces 100. In general, the headpiece 151 includes a fastening region that can be temporarily secured to the game-piece fastening region to remove a game piece from a stacked arrangement. According to the illustrated embodiment, the headpiece 151 includes a headband 152 and a headpiece fastening element 154. Depending on the embodiment, the headpiece 151 can take a variety of forms provided that the headpiece provides a location to position the headpiece fastening element 154 for game play. For example, they can be provided in the form of a cap, a helmet or other item that is secured to the head of the user 150. Further, in various embodiments, the headpiece 151 can include adjustable straps, clips, or other fastening systems, to provide a more secure fit during gameplay for various head sizes and shapes. In still other embodiments, a body-mounted fastening element that is worn on a body-part other than the head. For example, a band including a body-mounted fastening element can be configured to secure on a portion of a limb such as a forearm, upper arm, foot, calf or thigh.

Figure 9:
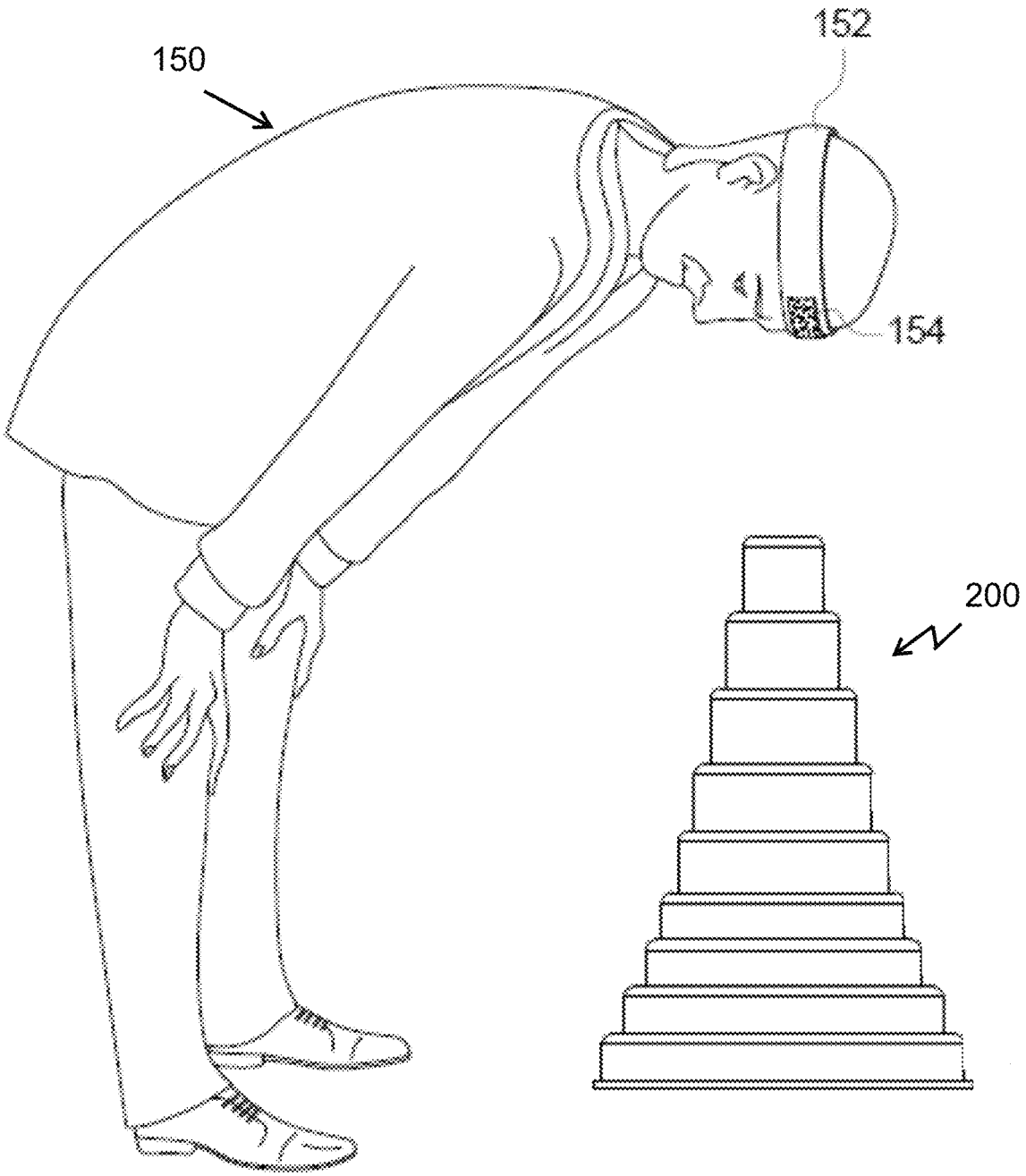
FIGS. 9 and 10 illustrate views of a user engaged in game play in accordance with one embodiment.
Figure 10:
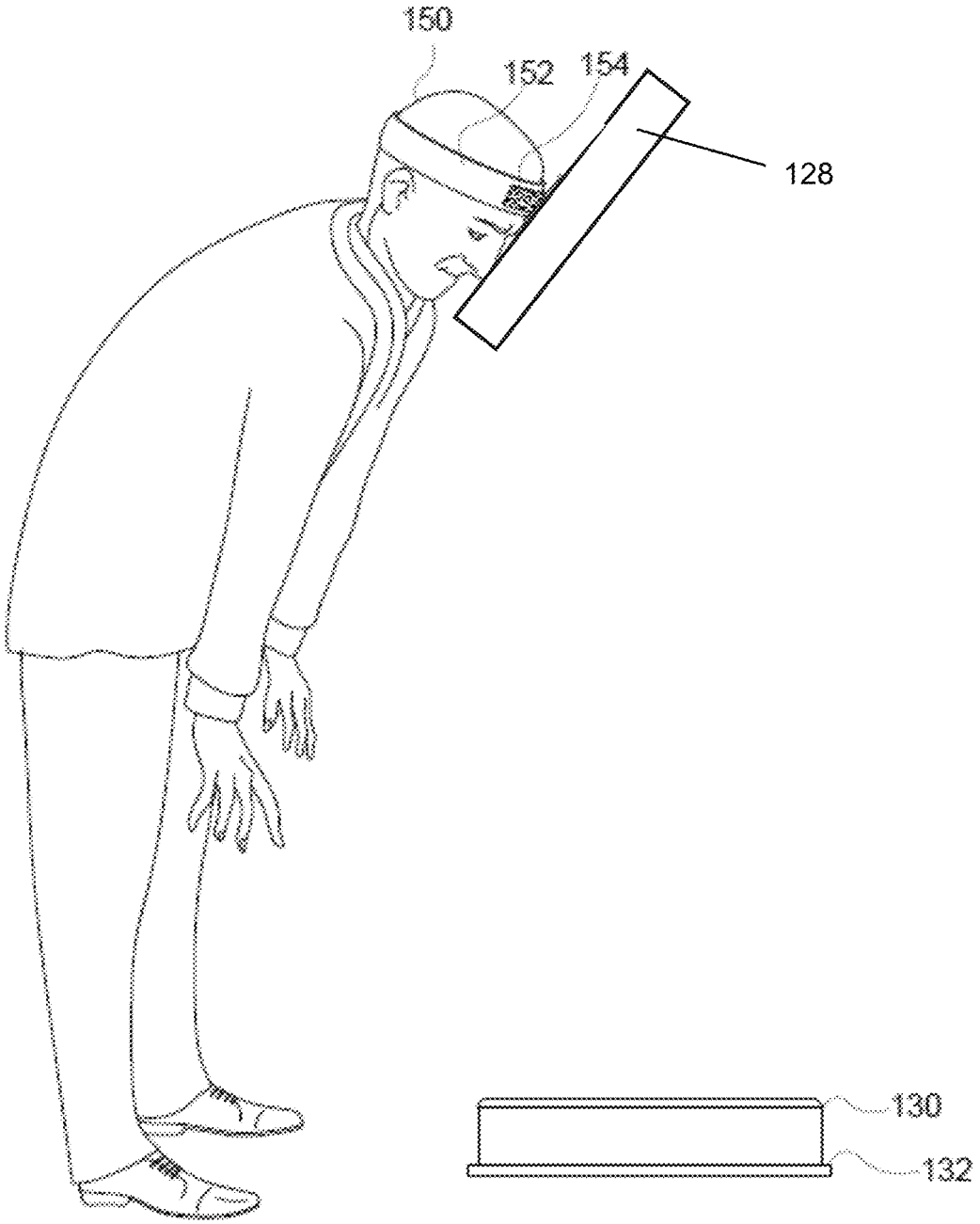

Referring now to FIGS. 9 and 10, gameplay involves the headpiece 151 worn by a player 150 in the illustrated embodiment in the form of a headband 152 including a headpiece fastening element 154. The player 150 moves their body to attach the headpiece fastening element 154 to the respective game-piece fastening element of a topmost game piece included in the plurality of game pieces in the stacked configuration to remove the topmost game piece and to do so without their hands. The player 150 attempts to remove the stacked game pieces in descending order, with each round requiring players to lift and remove the uppermost game piece by placing the headpiece fastening element 154 in contact with the game-piece fastening element of the uppermost game piece.

At each stage, the game piece is then detached from the headpiece. The player returns to the stacked arrangement as it remains following the removal of the uppermost game piece to try and repeat the process for that next lowest piece, that is the game piece that the topmost game piece previously rested upon (now the uppermost game piece in the stacked arrangement). As players succeed, components are removed one by one, increasing the challenge because each round requires the player to lower their head closer to the ground to attach the game piece to the headband as needed to lift the piece.

FIG. 9 illustrates the player 150 at the start of game play as the player bends forward to try and engage the headpiece fastening element 154 with the game-piece fastening element located on the topmost game piece in the stacked arrangement 200. Where the player 150 is successful, the game pieces are removed one at time forcing the player to move their body in a more extreme way as the height of the stack decreases. FIG. 10 illustrates a successful engagement by the player 150 between the headpiece fastening element 154 and the game-piece fastening element 129 included in the game piece 128. Once the player 150 removes the game piece 128 from the headpiece, the player can then try the greater challenge of moving their body to engage the headpiece fastening element 154 with the game-piece fastening element located on the game piece 130.

The game can be played by a single player as solo game play, with multiple players going head-to-head, or in various forms of team play with teams that each have multiple players. According to embodiments of each of these variations, a single stack of game pieces can be employed. In general, competitors take turns trying to remove the same layer from atop the stacked game pieces. The competitor who successfully removes the greatest number of layers (reducing the height of the stacked arrangement the most) is the winner. For example, when a first player removes the top game piece, the player then disconnects that piece from his headpiece and returns the game piece atop the stacked arrangement. The next player attempts to remove the same piece. The current round is completed after all players have an opportunity to remove that piece. In the next round, each of the players attempts to remove the next-lowest piece from the stacked arrangement. The game continues layer by layer until a player removes more pieces (that is, removes more layers to reduce a height of the stacked arrangement the most among all participants) than any of the other players. Players must remain on their feet, that is, no other body part can touch the ground during game play. For example, a player cannot have a hand, knee, elbow, or other body part touch the ground when it is their turn. Players are eliminated when they knock the stacked arrangement over or if they touch the ground with any body part other than their feet. As described herein, bonus rounds using accessory game pieces provide a way to break any ties, for example, if two players are each able to fully disassemble the stacked arrangement.

In another embodiment, where game play includes multiple players, a single set of game pieces can be employed serially in a single round, first by one player who removes as many game pieces from a stacked arrangement as they can, followed by a reassembly of the stacked arrangement, and play by a second player who removes as many game pieces from the newly assembled stacked arrangement as they can. The two players can be timed during their round to assist in determining a winner.

Figure 11:
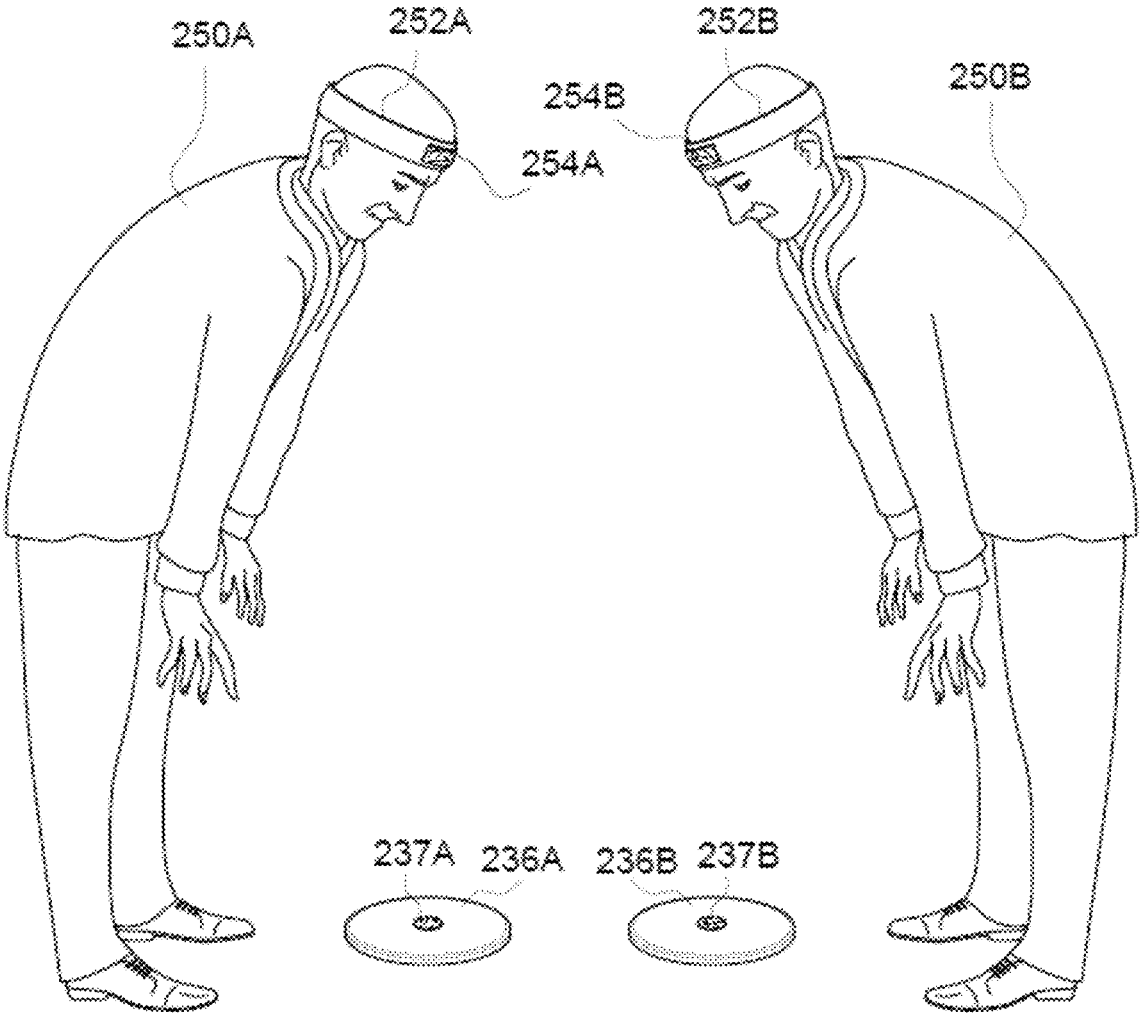
FIG. 11 illustrates a pair of users engaged in game play in accordance with another embodiment.

Referring now to FIG. 11, game play with the accessory game pieces 236A, 236B is illustrated in accordance with one embodiment. Here, a multi-player game including a first player 250A and a second player 250B is illustrated. As described above with reference to FIG. 2 and the accessory game pieces 136, accessory game pieces 236A, 235B are also thin discs that can be employed in a bonus round between two players. According to some embodiments, the bonus round is included as a tie-breaking round designed to determine the overall winner of the game where the players 250A, 250B each have previously removed all the game pieces included in a stacked arrangement of game pieces (for example, a stacked arrangement as illustrated in any of FIGS. 4-6 and 9). The thin disc like shape of the accessory game pieces 236A, 236B including a relatively small game-piece fastening region 237A, 237B can create the ultimate challenge for skilled players who have already successfully completed the sequential removal of all the game pieces from the stacked game pieces. According to some embodiments, the players 250A, 250B compete head-to-head, as illustrated, for a competitive and fast-paced final challenge. The tension and excitement of the race are emphasized by the players' 250A, 250B focused postures as they strive to be the first to successfully secure their respective headpiece fastening element 254A, 254B to the accessory game-piece fastening element 237A, 237B included in their accessory game pieces 236A, 236B.

Depending on the embodiment, the accessory game pieces 136, 236 include structural features such as textured surfaces, adjustable weights, or modular segments, providing varying challenges and enhancing the complexity of tie-breaking or final challenge rounds.

Figure 12:
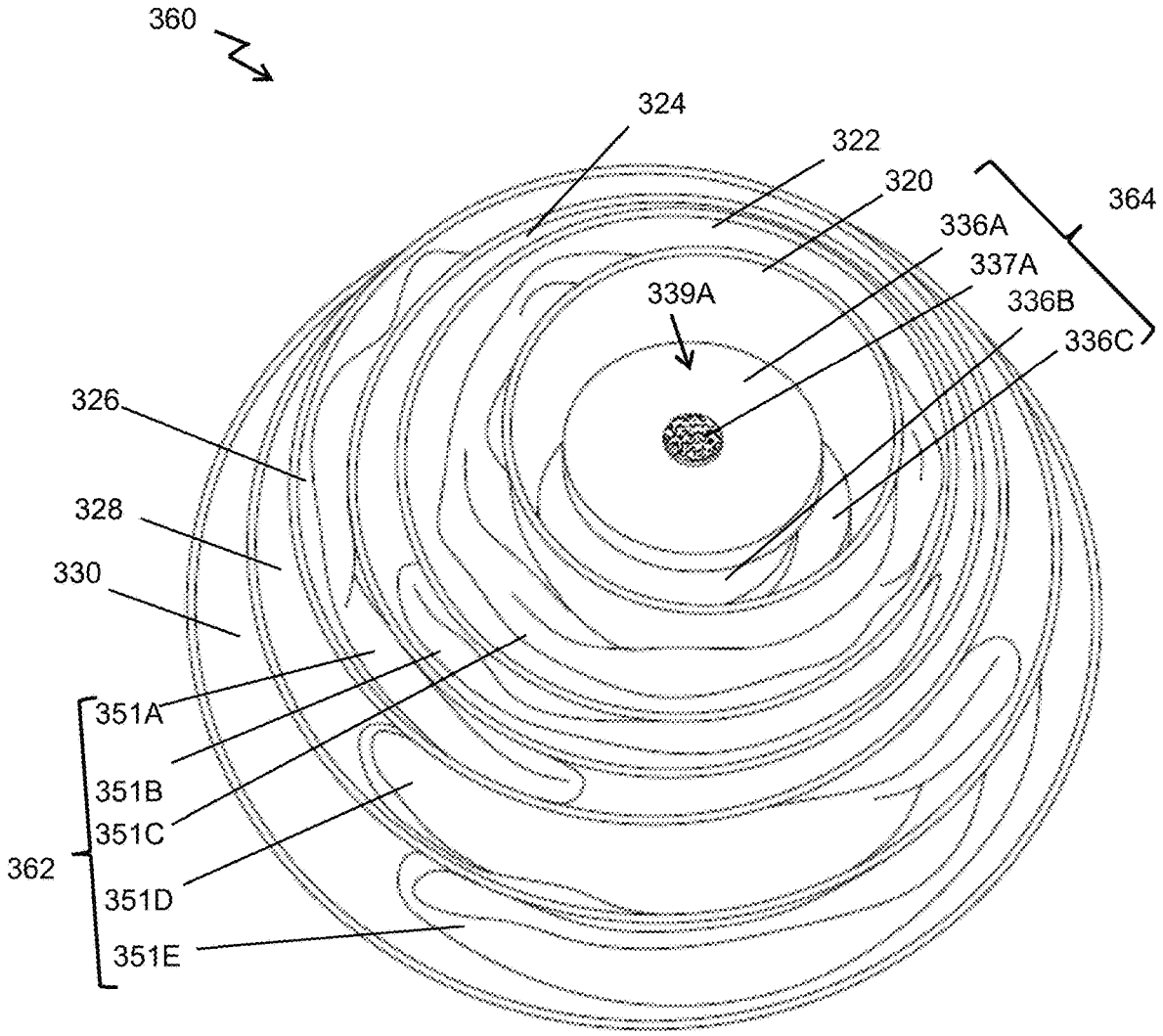
FIG. 12 illustrates an isometric view of a game-kit in accordance with one embodiment.

Various embodiments can provide a set of game pieces 100, 200, accessory game pieces 136, 236 and headpieces 151 as a kit including modular items that nest together for organized storage and easy transport. Referring now to FIG. 12, a kit 360 is illustrated in accordance with one embodiment. In various embodiments, a kit includes all items needed for players to engage in playing a game using stacked game pieces, in particular, a game where players attempt to dissemble a set of stacked items by sequentially removing game pieces off the top of the stack without use of their hands. In various embodiments, the game pieces are sized and shaped to facilitate the nested configuration illustrated in FIG. 12.

According to the illustrated embodiment, the kit 360 includes a set of game pieces including a first game piece 320, a second game piece 322, a third game piece 324, a fourth game piece 326, a fifth game piece 328, and a sixth game piece 330. A base, for example, the base 132 can also be included in various embodiments. The kit 360 also includes a plurality of headpieces 362 and a plurality of accessory game pieces 364. In the illustrated embodiment, three accessory game pieces are illustrated including a first accessory game piece 336A, a second accessory game piece 336B and a third accessory game piece 336C. Each of the plurality of accessory game pieces includes a top surface including a game-piece fastening element as represented by a top surface 339A including a game-piece fastening element 337 of the first accessory game piece 336A. According to one embodiment, each of the plurality of headpieces 362 includes a headband with an included headpiece fastening element as shown and described with reference to FIG. 8.

The compact and organized way the game pieces, accessory game pieces and headpieces are stored in FIG. 12, results at least in part from the structure of the game pieces themselves. That is, the open underside of the game pieces combined with the hollow interior defined by the body of each game piece 322, 324, 326, 328, 330 form a separate storage compartment when each game piece is inverted to position the game piece upside down with the top surface facing downward. In addition, the varied diameter that provides each game piece in a set of game pieces with an outside diameter that differs from the outside diameter of each of the remaining game pieces included in the set is an additional design feature that facilitates a compact nested storage of the all the elements included in the kit 360.

According to the illustrated embodiment, a difference in diameter between adjacent game pieces in the inverted, nested game pieces 322, 324, 326, 328, 330 provides storage space in which the set of headpieces 361 are stored. For example, the kit 360 can include enough headpieces for multi-player and team game play. According to the illustrated embodiment, the plurality of headpieces 362 includes the five headpieces 351A, 351B, 351C, 351D, 351E with one headpiece in the set placed in each of five separate storage space created within the storage stack. In the illustrated embodiment, the first game piece 320 provides an open storage space atop the storage stack in which the accessory game pieces 364 are stored.

In various embodiments, the kit 360 also includes a carrying case such as a box, bag or backpack. The carrying case is used for storage and transport of the game elements. For example, the lightweight and compact dimensions provided by the storage stack allow an individual to easily transport all the game elements to any location for game play. These can include indoor locations at home, office or other indoor space, as well as outdoor locations like a park or beach.

Various embodiments of game elements provided in a kit 360 or in multiple kits in combination can create customized challenges using timed challenges, skill-based tasks such as obstacle courses, or team-based objectives in combination with the disassembly of the stacked arrangement. Further, although the set of game pieces are illustrated as cylindrical or circular in shape where they are placed in a stack, other forms of game pieces can be employed to provide different challenges. For example, game pieces can include parallelogram shaped items each including a game-piece fastening element. These pieces can be arranged in a JENGA-like stack that requires the player to remove pieces from within a stacked arrangement without toppling the stack.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A kit including elements for a game that includes a hands-free removal of game pieces from atop a stacked arrangement, the stacked arrangement supported by a surface on which it is assembled to remain vertical independent of any other form of support, the kit comprising:

a set of game pieces including:

a first game piece configured to place at a bottom position in the stacked arrangement, the first game piece having a first game-piece height and a first game-piece outside diameter, the first game-piece height being the smallest height included in the respective game-piece heights, the first game-piece outside diameter being the largest outside diameter included in the respective game-piece outside diameters; and a second game piece configured to place at a top position in the stacked arrangement, the second game piece having a second game-piece height and a second game-piece outside diameter, the second game-piece height being different than the first game-piece height and being the largest height included in the respective game-piece heights, the second game-piece outside diameter being different than the first game-piece outside diameter and being the smallest outside diameter included in the respective game-piece outside diameters, each of the game pieces included in the set of game pieces includes a top surface having a game-piece fastening element included thereon, respectively, each of the respective game-piece fastening elements configured to secure to a corresponding headpiece fastening element worn by a user when contact is made between the respective game-piece fastening element and headpiece fastening element during game play; and a headpiece for wear by the player during game play, the headpiece including the corresponding headpiece fastening element, the corresponding headpiece fastening element configured to be placed in contact with the game-piece fastening element with the headpiece being worn by the player, the contact forming a temporary attachment of the respective game piece and the headpiece to allow the player to complete the contact and then lift the respective game piece from a position atop the stacked arrangement.

2. The set of game pieces of claim 1, further comprising a plurality of additional game pieces, each of the plurality of additional game pieces having a game-piece outside diameter, respectively, that differs from the respective game-piece diameter of all others of the game pieces included in the set of game pieces, wherein each of the plurality of additional game pieces includes the top surface having a game piece fastening element included thereon, respectively, and wherein the plurality of additional game pieces are sized and configured to locate above the first game piece and below the second game piece within the stacked arrangement.

3. The set of game pieces of claim 2, wherein an alignment groove is located in the top surface of each game piece included in the set of game pieces, respectively, and wherein the alignment grooves are configured to engage with a bottom edge of a sidewall included in the respective game piece that is placed upon the top surface of the respective game piece.

4. The set of game pieces of claim 3, wherein the game-piece outside diameter of each game piece included in the set of game pieces is defined by an overall circular shape of the respective game piece, and wherein the diameter of each of the respective alignment grooves is substantially equal to the game-piece outside diameter of an individual game piece included in the set of game pieces that is placed upon the respective game piece in the stacked arrangement.

5. The set of game pieces of claim 4, wherein the stacked arrangement is configured to provide a stable vertical structure including all the pieces included in the set of game pieces within the stacked arrangement based on the force of gravity and independent of any adhesive.

6. The set of game pieces of claim 1, wherein each game piece included in the set of game pieces, respectively, includes a body including a top wall that defines the top surface and a bottom surface located on an underside of the top wall, the body including a side wall that extends perpendicular from the bottom surface in a direction that is opposite to a direction of the top surface, and wherein the body includes a hollow interior region defined beneath the bottom surface within the side wall.

7. The set of game pieces of claim 6, wherein the side wall defines a bottom edge of the body, and wherein the bottom edge defines a base of the respective game piece, the base configured to place on the top surface of the respective game piece located adjacent and immediately below the respective game piece within the stacked arrangement.

8. A kit including elements for a game that includes a hands-free removal of game pieces from atop a stack of game pieces, the stack supported by a surface on which it is assembled to remain vertical independent of any other form of support, the kit comprising:

a plurality of game pieces each game piece included in the plurality of game pieces including a game-piece fastening element, a game-piece height and a game-piece outside diameter, respectively, the plurality of game pieces including:

a first game piece configured to place at a bottom position in the stack of game pieces, the first game piece having a first game-piece height and a first game-piece outside diameter, the first game-piece height being the smallest height included in the respective game-piece heights, the first game-piece outside diameter being the largest outside diameter included in the respective game-piece outside diameters; and a second game piece configured to place at a top position in the stack of game pieces, the second game piece having a second game-piece height and a second game-piece outside diameter, the second game-piece height being different than the first game-piece height and being the largest height included in the respective game-piece heights, the second game-piece outside diameter being different than the first game-piece outside diameter and being the smallest outside diameter included in the respective game-piece outside diameters; and a headpiece for wear by a player during game play, the headpiece including a headpiece fastening region configured to be placed in contact with the game-piece fastening element with the headpiece being worn by the player, the contact forming a temporary attachment of the respective game piece and the headpiece to allow the player to complete the contact and then lift the respective game piece from a position atop the stacked arrangement.

9. The kit of claim 8, further comprising a plurality of headpieces, each one of the plurality of headpieces including a headband, respectively.

10. The kit of claim 9, wherein the headpiece fastening element includes at least one of a hook and loop fastener, and/or a magnet.

11. The kit of claim 8, wherein the plurality of game pieces include a body having a hollow interior region, wherein the plurality of game pieces are configured to be inverted to allow a nested storage arrangement in which the second game piece is placed within the body of the first game piece for storage along with a headpiece located in a hollow interior region of the first game piece.

* * * * *